US010618052B2

(12) United States Patent
Ishikawa et al.

(10) Patent No.: US 10,618,052 B2
(45) Date of Patent: Apr. 14, 2020

(54) MEDIA-CIRCULATION TYPE PULVERIZER

(71) Applicant: ASHIZAWA FINETECH LTD., Narashino-shi, Chiba (JP)

(72) Inventors: Tsuyoshi Ishikawa, Narashino (JP); Yasuhiro Mitsuhashi, Narashino (JP); Takahiro Tamura, Narashino (JP); Tsubasa Nakajima, Narashino (JP)

(73) Assignee: ASHIZAWA FINETECH LTD (JP)

( * ) Notice: Subject to any disclaimer, the term of this patent is extended or adjusted under 35 U.S.C. 154(b) by 245 days.

(21) Appl. No.: 15/736,344

(22) PCT Filed: Apr. 11, 2017

(86) PCT No.: PCT/JP2017/014764
§ 371 (c)(1),
(2) Date: Dec. 14, 2017

(87) PCT Pub. No.: WO2017/217093
PCT Pub. Date: Dec. 21, 2017

(65) Prior Publication Data

US 2019/0001338 A1 Jan. 3, 2019

(30) Foreign Application Priority Data

Jun. 14, 2016 (JP) ..... 2016-117575

(51) Int. Cl.
*B02C 17/16* (2006.01)
*B02C 17/18* (2006.01)

(52) U.S. Cl.
CPC ..... *B02C 17/166* (2013.01); *B02C 17/161* (2013.01); *B02C 17/163* (2013.01); *B02C 17/1815* (2013.01)

(58) Field of Classification Search
CPC . B02C 17/166; B02C 17/161; B02C 17/1835; B02C 17/163; B02C 17/168; B02C 2017/165
(Continued)

(56) References Cited

U.S. PATENT DOCUMENTS 5,518,191 A * 5/1996 Bartsch ..... B02C 17/161 241/171
2014/0091165 A1* 4/2014 Ishikawa ..... B02C 17/161 241/79

FOREIGN PATENT DOCUMENTS

DE 10241924 B3 * 5/2004 ..... B01F 7/008
JP 4-78944 U 7/1992
(Continued)

OTHER PUBLICATIONS

Description Machine Translation of JP 2006-314881 A, via Espacenet.com, accessed Oct. 8, 2019 (Year: 2006).*
(Continued)

*Primary Examiner* — Magdalena Topolski
*Assistant Examiner* — Nicholas E Brown
(74) *Attorney, Agent, or Firm* — Renner Kenner Greive Bobak Taylor & Weber

(57) ABSTRACT

The media-circulation type pulverizer comprising: an agitating member disposed in a lower region of a pulverization chamber; an annular partition wall disposed to extend upwardly in the pulverization chamber; and a media guide member provided on a lower surface of the end plate of the agitating member, wherein the annular partition wall has a height set to be ⅗ to ⅘ of a height of the pulverization chamber, and the media guide member has a lower end which enters a space of the inner region of the pulverization chamber located inside the annular partition wall, and wherein a vertically-extending flow straightening blade is provided between said lower portion of the media guide
(Continued)

member and an upper portion of the annular partition wall, and the media separation member is provided on the lower end of the lower portion of the media guide member.

7 Claims, 3 Drawing Sheets

(58) Field of Classification Search
USPC ..... 241/39
See application file for complete search history.

(56) References Cited

FOREIGN PATENT DOCUMENTS

| | | | | |
|---|---|---|---|---|
| JP | 2006-314881 | A | | 11/2006 |
| JP | 2006314881 | A | * | 11/2006 |
| JP | 2010-253339 | A | | 11/2010 |
| JP | 2014-18797 | A | | 2/2014 |

OTHER PUBLICATIONS

Description Machine Translation of DE 10241924 B3, via Espacenet.com, accessed Oct. 7, 2019 (Year: 2004).*

* cited by examiner

MEDIA-CIRCULATION TYPE PULVERIZER

TECHNICAL FIELD

The present invention relates to a media-circulation type pulverizer. The media-circulation type pulverizer of the present invention is particularly suitable for use in, but not limited to, mixing a raw material, such as ink, paint, pigment, ceramic, metal, inorganic material, dielectric, ferrite, toner, glass, paper coating color or nanoparticles, with pulverizing-dispersing media in the form of beads, to pulverize or disperse the raw material into fine particles.

BACKGROUND ART

As a media-circulation type pulverizer, there has been known a media-agitation mill proposed in JP 2005-199125 A.

The media-agitation mill proposed in the JP 2005-199125 A comprises: a pulverization tank including an end plate closing up an upper end thereof and internally having a pulverization chamber containing pulverizing media; a rotary shaft rotatably provided in the pulverization tank; and an agitating/separating member provided on a portion of the rotary shaft located inside the pulverization chamber and configured to be rotatable integrally with the rotary shaft. This media-agitation mill is characterized in that an inner wall surface of the pulverization chamber and an outer peripheral surface of the agitating/separating member are formed in shapes conforming to each other, wherein the media-agitation mill further comprises a separation/discharge passage extending from the outer peripheral surface of the agitating/separating member to penetrate through a central portion of the agitating/separating member and then extending therefrom to penetrate through a central portion of the rotary shaft and communicate with an outside of the pulverization chamber, and a pressure relief hole penetrating between upper and lower surfaces of the agitating/separating member in an axial direction of the rotary shaft to provide communication between upper and lower regions of an inside of the pulverization chamber.

However, in the media-agitation mill having the above structure, the pulverizing media are liable to be concentrated around a maximum-diameter portion where a centrifugal force is maximized, i.e., to be localized in a specific position, so that a dispersion or pulverization force varies with position, and the variation is large. Thus, there is a problem that a raw material is not uniformly dispersed or pulverized, causing difficulty in obtaining a high-quality product.

Therefore, the applicant of this application proposed a media-circulation type pulverizer capable of obtaining a high-quality product by a good pulverizing-dispersing action, in Japanese patent application No. 2009-103529 (JP 2010-253339 A).

The media-circulation type pulverizer proposed in this application comprises: a pulverization container having an upright cylindrical pulverization chamber containing pulverizing media in the form of beads; a raw-material-slurry supply port provided in the pulverization container; an agitating member disposed in a lower region of the pulverization chamber and having a rotary shaft substantially coaxial with a central axis of the pulverization chamber; and a media separation member provided within the pulverization chamber and above the agitating member. This media-circulation type pulverizer is characterized in that it further comprises a guide ring installed to radially divide a lower region of the pulverization chamber into an inner section and an annular outer section, thereby to form said outer section of the lower region of the pulverization chamber as an upward flow path of a mixture of pulverizing media and the raw material slurry.

In the media-circulation type pulverizer proposed in the Japanese patent application No. 2009-103529, the guide ring is installed in the pulverization chamber, as mentioned above, whereby a flow of the mixture of the pulverizing media and the raw material slurry can be formed as a combined flow (i.e., helicoidal flow) consisting of a flow moving in a circumferential direction of the pulverization chamber (i.e., a primary flow) and a flow capable of regularly repeating a movement cycle of, after moving in a radially outward direction of the pulverization chamber toward an inner wall of the pulverization container, moving upwardly through the upward flow path between the guide ring and the pulverization container, and then moving downwardly from a central region of the pulverization chamber to return to the agitating member, via a space inward of the guide ring (i.e., a secondary flow). Thus, even if a volume ratio of beads to the pulverization chamber is relatively low, segregation of the pulverization media can be suppressed to some extent to provide enhanced pulverization/dispersion efficiency.

However, the helicoidal flow formed by the media-circulation type pulverizer proposed in this patent application is unstable due to weakness and instability of the secondary flow thereof, so that due to centrifugal force, dynamic localization is likely to occur, which causes segregation of the pulverization media in the helicoidal flow. Thus, there is a problem of non-uniform pulverization and not-so-good energy efficiency.

Therefore, the applicant of this application proposed a media-circulation type pulverizer capable of creating a uniformized, stable helicoidal flow without dynamic localization due to centrifugal force in a mixture of pulverizing media and a raw material slurry, without unevenness of a centrifugal force distribution, thereby performing pulverization/dispersion uniformly with good energy efficiency, in JP 2014-018797 A.

The media-circulation type pulverizer proposed in the 2014-018797 A comprises: a pulverization container including an end plate closing up an upper end thereof and having an upright cylindrical pulverization chamber containing pulverizing media in the form of beads; a raw-material-slurry supply port provided in the pulverization container; an agitating member disposed in a lower region of the pulverization chamber and having a rotary shaft substantially coaxial with a central axis of the pulverization chamber; and a media separation member provided within the pulverization chamber and above the agitating member. This media-circulation type pulverizer is characterized in that it further comprises: a guide ring installed to radially divide a lower region of the pulverization chamber into an inner section and an annular outer section, whereby a flow of a mixture of the raw material slurry and the pulverizing media is formed as a helicoidal flow comprising a combination of a primary flow flowing in a circumferential direction of the pulverization chamber and a secondary flow flowing through a circulation flow path which has an upward flow path and a downward flow path created, respectively, in the outer section and the inner section of the lower region of the pulverization chamber, with respect to the guide ring; and rotational-flow suppressing means provided within the pulverization chamber and configured to suppress the primary flow while strengthening the secondary flow, thereby stabilizing the helicoidal flow, wherein the rotational-flow suppressing means is formed in a cruciform shape and provided inside the guide ring, and the guide ring provided with the rotational-flow suppressing means is disposed above the agitating member.

In the above media-circulation type pulverizer, regarding the helicoidal flow of the mixture of the raw material slurry and the pulverizing media, it becomes possible to suppress the primary flow of the helicoidal flow, i.e., a rotational flow in the circumferential direction of the pulverization chamber, and strengthen the secondary flow of the helicoidal flow (circulation flow around the guide ring). This makes it possible to stabilize the helicoidal flow and uniformize distribution of the pulverizing media in the flow to provide a flow having highly repetitive shear optimal to pulverization/dispersion with good energy efficiency.

CITATION LIST

Parent Document

Patent Document 1: JP 2005-199125 A
Patent Document 2: JP 2010-253339 A
Patent Document 3: JP 2014-018797 A

SUMMARY OF INVENTION

Technical Problem

It is an object of the present invention to provide a media-circulation type pulverizer capable of achieving good separation of pulverizing media with a simpler structure than that of the media-circulation type pulverizer proposed in the JP 2014-018797 A.

Solution to Technical Problem

The above object is achieved by a media-circulation type pulverizer of the present invention having the following features set forth in (1) to (10).

(1) A media-circulation type pulverizer which comprises: a pulverization container including an end plate closing up an upper end thereof and having an upright cylindrical pulverization chamber containing pulverizing media in the form of beads; a raw-material-slurry supply section provided in the pulverization container; an agitating member disposed in a lower region of the pulverization chamber and having a rotary shaft substantially coaxial with a central axis of the pulverization chamber; an annular partition wall disposed to extend upwardly from a position surrounding an outer periphery of the agitating member or a position radially away from the outer periphery by a given distance, so as to radially divide an internal space of the pulverization chamber to form an inner region of a pulverization chamber and an annular outer region of a pulverization chamber; a media guide member provided on a central area of a lower surface of the end plate to extend downwardly and configured to turn a mixture of a raw material slurry and pulverizing media being moved upwardly through the outer region of the pulverization chamber by an action of the agitating member, to a downward flow so as to direct the mixture toward the inner region of pulverization chamber; a media separation member provided underneath the media guide member; and a product slurry discharge section provided inside the media guide member and communicating with an inside of the media separation member so as to enable a product slurry after separation of the pulverizing-dispersing media by the media separation member to be discharged to outside therethrough, wherein the media-circulation type pulverizer is operable to circulate the pulverizing media between the inner region of the pulverization chamber and the outer region of the pulverization chamber to pulverize a raw material in the raw material slurry by the pulverizing media being circulated.

(2) In the media-circulation type pulverizer as set forth in (1), the agitating member comprises a hub having a portion extended to a vicinity of a lower surface of the media guide member so as to define a small gap between an upper surface of the portion of the hub and the lower surface of the media guide member, wherein the media separation member is a gap separator formed by the small gap.

(3) In the media-circulation type pulverizer set forth in (2), the media separation member is a screen separator provided underneath the media guide member.

(4) In the media-circulation type pulverizer set forth in any one of (1) to (3), the media guide member is formed as a downwardly tapered, circular truncated cone-shaped guide member.

(5) In the media-circulation type pulverizer set forth in any one of (1) to (4), the media guide member has a lower end which enters a space of the inner region of the pulverization chamber located inside the annular partition wall.

(6) The media-circulation type pulverizer set forth in any one of (1) to (5), which is configured to enable cooling water to pass through an inside of the media guide member and/or an inside of the annular partition wall.

(7) In the media-circulation type pulverizer set forth in any one of (1) to (6), the annular partition wall has a height dimension set to be ⅗ to ⅘ of a height dimension of the pulverization chamber.

(8) In the media-circulation type pulverizer set forth in any one of (1) to (7), the pulverizing media has a diameter of 0.2 to 2.0 mm.

(9) In the media-circulation type pulverizer set forth in any one of (1) to (8), the annular partition wall is made of a resin material.

(10) In the media-circulation type pulverizer set forth in any one of (1) to (8), the annular partition wall is made of a ceramic material.

Effect of Invention

If a media-circulation type pulverizer is devoid of the media guide member of the present invention, a large number of pulverizing media stagnate in an upper region of the pulverization chamber, thereby making it impossible to sufficiently bring out capability of the media separation member. In contrast, in the media-circulation type pulverizer of the present invention, the media separation member is provided underneath the media guide member. Thus, the pulverizing media around the media separation member located underneath the media guide member are moved while riding on a circulating flow formed as a strong downward flow by the media guide member, so that the pulverizing media are less likely to gather around the media separation member. This makes it possible to sufficiently bring out capability of the media separation member.

DESCRIPTION OF EMBODIMENTS

With reference to the accompanying drawings, a media-agitation type pulverizer of the present invention will now be described based on one embodiment thereof.

Figure 1:
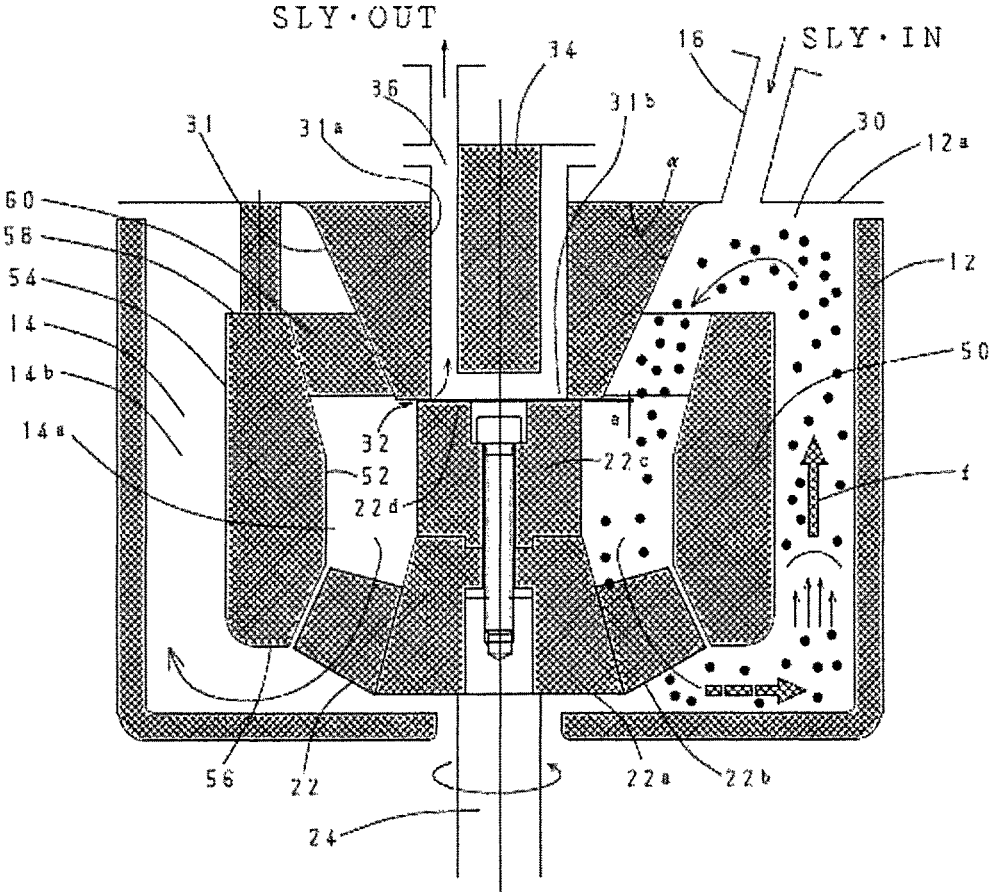
FIG. 1 is a sectional view showing a media-circulation type pulverizer according to one embodiment of the present invention.

FIG. 1 shows a media-circulation type pulverizer 10 according to one embodiment of the present invention. This media-circulation type pulverizer 10 comprises an upright cylindrical pulverization container 12 including an end plate 12*a* closing up an upper end thereof. The pulverization container 12 internally has a columnar pulverization chamber 14, and is provided with a raw-material-slurry supply port 16 for introducing a raw material in a slurry form into the pulverization chamber 14.

In a lower central region of an internal space of the pulverization chamber 14 of the pulverization container 12, an agitating member 22 having a rotational axis approximately coaxial with a central axis of the pulverization chamber 14 is rotatably disposed. The agitating member 22 is composed of a centrifugal impeller which comprises, for example, a hub 22*a* and a plurality of blades 22*b* fixed therearound.

The hub 22*a* of the agitating member 22 is fixed to an upper end of a rotary drive shaft 24 which is an agitating-member driving shaft extending axially downwardly from the upper end while penetrating through the pulverization container 12. The rotary drive shaft 24 has a lower end which is connected to a drive source via a well-known drive mechanism (not shown) in such a manner as to be rotationally driven in the direction indicated by the arrowed line in FIG. 1. Preferably, the rotary drive shaft 24 has a rotation shaft (a rotational axis) aligned with the central axis of the pulverization chamber 14. Further, the rotary drive shaft 24 is provided with a shaft seal (e.g., a mechanical seal).

In place of the above centrifugal impeller, the agitating member 22 may be composed of a diagonal flow impeller.

As is well known in the field of media-circulation type pulverizers, pulverizing media 30 in the form of beads (which are shown in the figures in a significantly enlarged manner) are contained in the pulverization container 12. As the pulverizing media 30, it is possible to use pulverizing media having a diameter of 0.2 to 2 mm. A total volume of the pulverizing media is 30 to 80% of a volume of the pulverization chamber.

Figure 2:
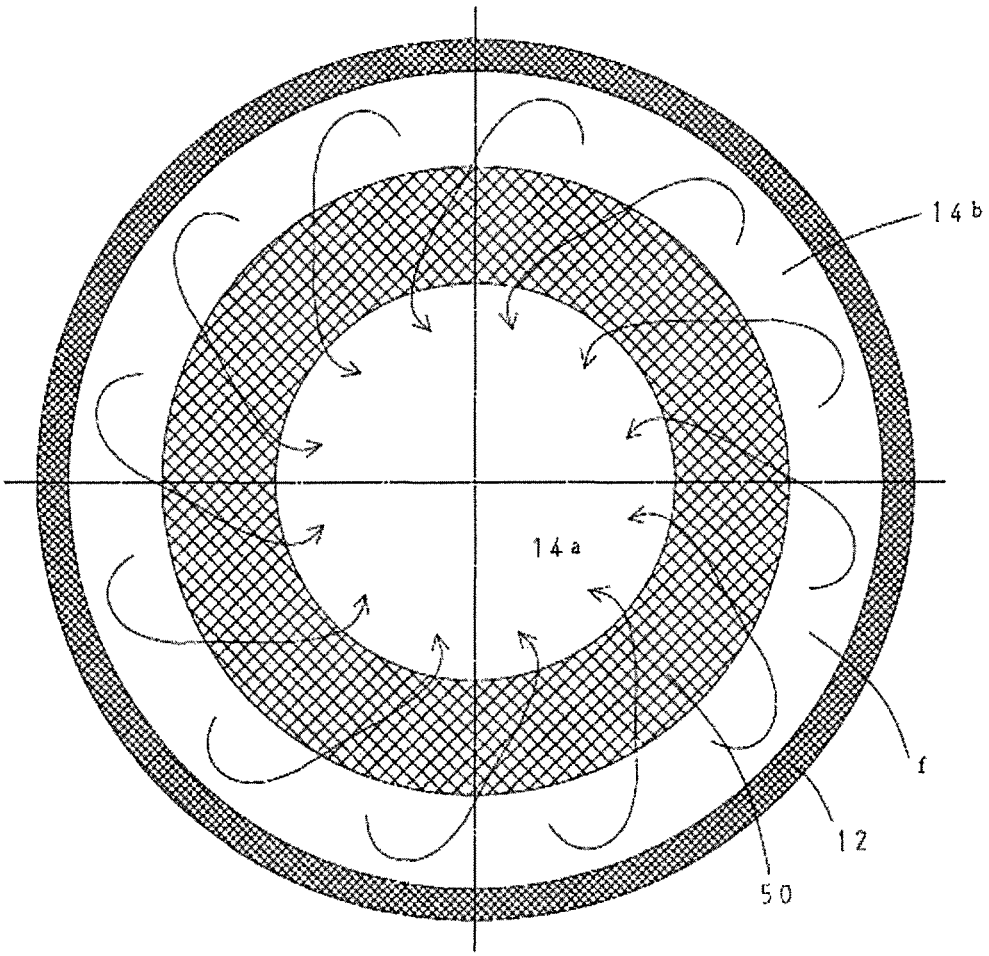
FIG. 2 is a horizontal sectional view of the media-circulation type pulverizer shown in FIG. 1, wherein only a pulverization container and an annular partition wall are shown.

The end plate 12*a* has a lower surface provided with a media guide member 31 configured to turn a flow f of a mixture of a raw material slurry and the pulverizing media 30 moving upwardly, to a downward flow (see FIG. 2). This media guide member 31 is composed of a downwardly tapered, circular truncated cone-shaped member which is provided on a central area of the lower surface of the end plate 12*a* and has a cylindrical internal space 31*a*, wherein said circular truncated cone-shaped member is configured such that an outer peripheral surface thereof is configured to turn the mixture of a raw material slurry and the bead-form pulverizing-dispersing media moving upwardly by an action of the agitating member, to a downward flow.

Preferably, an angle $\alpha$ between an inclined surface and an upper surface (larger-area surface) of the media guide member 31 is set to be 45 to 90 degrees.

A media separation member 32 is provided underneath the media guide member 31 and configured to separate the media 30 dispersed in the raw material slurry, from the raw material. As shown in FIG. 1, the hub 22*a* of the agitating member 22 is extended upwardly to form an extended portion serving as a separation member-constructing member 22*c*. The media guide member 31 operates as a gap separator formed by a small gap defined between a circular upper surface 22*d* of the separation member-constructing member and a circular lower surface 31*b* of the media guide member 31. Preferably, a width e of the gap is about ⅓ of the diameter of the pulverizing media. This gap separator has a simple structure and can be constructed at low cost.

Preferably, the media separation member 32 has a radius less than a radius of the lower surface of the media guide member 31. This is intended to prevent most of the pulverizing media 30 flowing downwardly along the inclined surface of the media guide member 31 from gathering toward the media separation member 32 so as to provide good media separation capability to the media separation member 32.

The media guide member 31 has a cylindrical-shaped internal space 31*a* into which a cylindrical-shaped discharge nozzle-defining member 34 having an outer diameter less than an inner diameter of the cylindrical-shaped internal space 31*a* is inserted, so that a discharge nozzle 36 for enabling a product slurry after separation of the pulverizing media 30 by the media separation member 32 to be discharged to the outside of the pulverizer therethrough is defined between an outer periphery of the discharge nozzle-defining member 34 and an inner periphery of the media guide member 31.

Within the pulverization chamber 14, an annular partition wall 50 is disposed to extend upwardly from a position surrounding an outer periphery of the blades 22*b* of the agitating member 32 or a position radially away from the outer periphery by a given distance. This annular partition wall 50 is composed of an inner peripheral annular plate 52, an outer peripheral annular plate 54 spaced apart radially outwardly from the inner peripheral annular plate 52, a lower annular plate 56 forming a lower side thereof, and an upper annular plate 58 forming an upper side thereof, wherein an internal space of the annular partition wall 50 is formed in a liquid-tight manner.

Preferably, the annular partition wall 50 has a height dimension which is ⅗ to ⅘ of a height dimension of the pulverization chamber 14.

Preferably, a lower end of the media guide member 31 enters a space of the aftermentioned inner region of the pulverization chamber inside the annular partition wall.

This annular partition wall 50 is disposed to radially divide a given space of the pulverization chamber 14 to form an inner region of a pulverization chamber 14*a* and an annular outer region of a pulverization chamber 14*b*. The inner region of the pulverization chamber 14*a* serves as a downward passage of the mixture of the pulverizing media and the raw material slurry, and the outer region of the pulverization chamber 14*b* serves as an upward passage of the mixture of the pulverizing media and the raw material slurry. Thus, the flow f of the mixture of the pulverizing media and the raw material slurry is formed within the pulverization chamber 14 as a combined flow (i.e., helicoidal flow) consisting of a flow moving in a circumferential direction of the pulverization chamber 14 (i.e., a primary flow) and a flow capable of regularly repeating a movement cycle of, after moving in a radially outward direction of the pulverization chamber toward an inner wall of the pulverization container, moving upwardly through an upward flow path between the annular partition wall and the pulverization container, and then moving downwardly by an effect of the media guide member 31 from a central region of the pulverization chamber 14 to return to the agitating member 22, via the inside of the annular partition wall (i.e., a secondary flow). Generally, this helicoidal flow involves a problem of being unstable due to weakness and instability of the secondary flow thereof. Therefore, preferably, a vertically-extending flow straightening blade 60 is provided between a lower portion of the media guide member 31 and an upper portion of the annular partition wall 50, as depicted in FIG. 1, to strengthen and stabilize the secondary flow and suppress the primary flow. By providing the straightening blade 60, it is possible to maximally restrict the free flow of the media in the pulverizing chamber 14 by the downward flow of mixture of the raw material slurry and the bead-form pulverizing media, to thereby reduce a concentration of the media around the media separation member 32 and restrict media floating toward the media separation member to provide further enhanced separation capacity to the media separation member. In addition, based on strengthening the secondary flow to form stable helicoidal flow, it is possible to uniformize a distribution of the pulverizing media in the helicoidal flow and eliminate dynamic localization due to centrifugal force, to thereby generate active shearing force between the pulverizing media to provide further enhanced function to the pulverizing media.

Preferably, a distance between an outer peripheral wall of the annular partition wall and an inner peripheral wall of the pulverization container is in the range of 10 to 50 mm. If the distance is less than the lower limit, the movement of the beads is excessively restricted. On the other hand, if the distance is greater than the upper limit, free flowability of the beads is excessively increased.

A jacket (not depicted) for enabling a cooling medium (cooling water) to pass therethrough is provided along an outer periphery of the pulverization container 12, so as to cool the pulverization chamber 14. This jacket has a lower portion provided with a coolant water inlet for introducing cooling water therethrough and an upper portion provided with a cooling water outlet 46 for discharging the cooling water therethrough.

The annular partition wall 50 is formed in the above structure having an annular internal space, and supported by a plurality of pipes 62 attached to the pulverization container. The pipes 62 can be used to enable cooling water to be supplied into and discharged from the annular internal space therethrough. Thus, in this embodiment, it is possible to additionally cool the raw material slurry from the inside of the pulverization container 12.

Preferably, each of the pipes 62 is disposed to extend downwardly from the upper end of the pulverizing container 12 to have a lower end supporting the guide ring 50, as shown in the drawing.

Further, the media guide member 31 may be formed to define an internal space therein, and cooling water may be supplied to pass through this internal space, so as to cool the raw material slurry which is circulated or newly supplied raw material slurry.

Furthermore, when cooling water is to passed through an internal space of the discharge nozzle-defining member 34, the slurry flowing through the discharge nozzle 36 can be cooled by both the cooling water passing through the discharge nozzle-defining member 34 and the cooling water passing through the media guide member 31.

Generally, the slurry discharged from the pulverizer needs to be cooled. Thus, conventionally, a heat exchanger or the like has been provided in a circulation pathway. The above structure makes it possible to eliminate the need for or simplify such a heat exchanger, thereby achieving a significant reduction in cost.

The pulverization container 12 is configured such that the end plate 12*a* can be removed to open the pulverization container 12 so as to facilitate maintenance.

Figure 3:
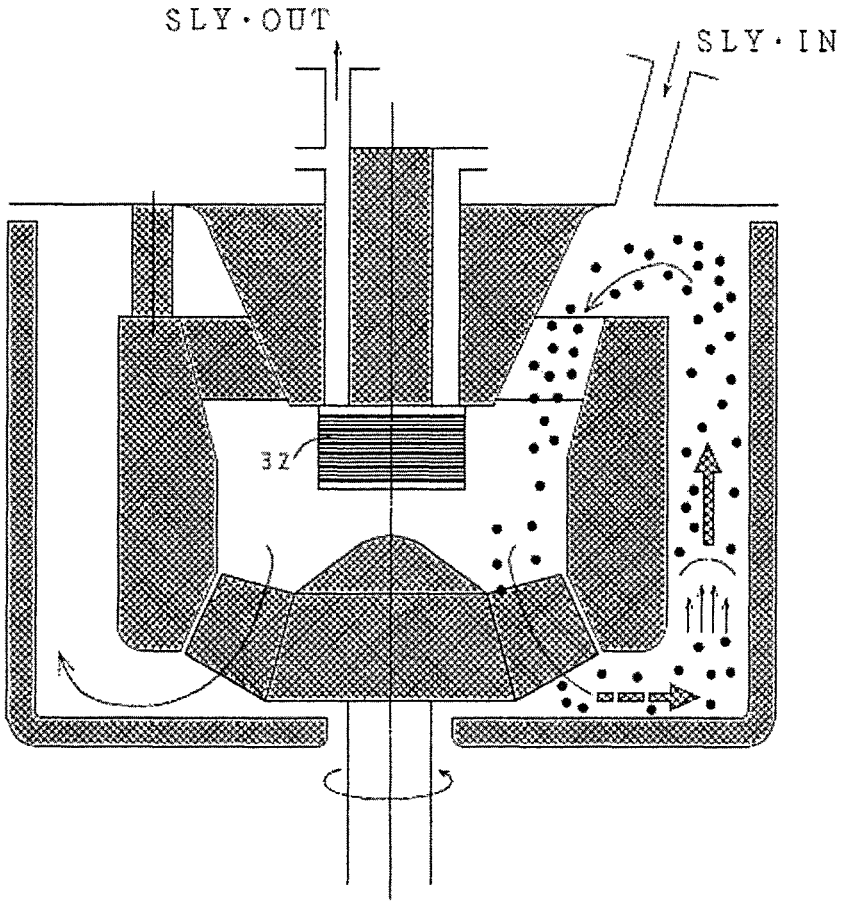
FIG. 3 is a sectional view of a modification of the media-circulation type pulverizer comprising a different type of media separation member.

In the media-circulation type pulverizer of the present invention, the agitating member 22 can be rotationally driven at a circumferential velocity of 4 to 40 m/s In the above embodiment, the media separation member is composed of a gap separator. Alternatively, the media separation member may be composed of a screen type as shown in FIG. 3.

In operation, the agitating member 22 is rotationally driven, while a raw material slurry containing target particles to be pulverized, as a raw material, is introduced into the pulverization chamber 14 from the raw material supply port. The slurry introduced into the pulverization chamber 14 is moved downwardly toward the agitating member 22, while riding on an already-formed circulating flow of a raw material slurry and the pulverizing media 30 in the pulverization chamber 14, and mixingly agitated by the agitating member 22. Subsequently, the resulting mixture of the slurry and the media 30 is moved radially outwardly up to the inner peripheral wall of the pulverization container 12, and then turned to form a flow f moving upwardly through the upward passage between the inner peripheral wall of the pulverization chamber 14 and the guide ring 50. Then, when the mixture is moved upwardly to a vicinity of the end plate 12*a*, it is turned to form the aforementioned downward flow.

In this flow pathway, a part of the media having a relatively large mass are biased downwardly and separated from the slurry. In this case, an insufficiently-pulverized part of the target particles having a relatively large particle size behave in the same manner as the media. On the other hand, slurry containing sufficiently-pulverized particles having a relatively small particle size enters into an internal space of the media separation member 32 and discharged to the outside of the media-circulation type pulverizer via the discharge nozzle 36 inside the media guide member 31. By this construction, raw material particles can be subjected to good-quality pulverization and dispersion in an adequately regulated flow through a contact with freely-moving pulverizing media, thereby obtaining a high-quality product. Further, according to the media-circulation type pulverizer of the present invention, by the above-functions, it is possible to achieve pulverization with a narrow particle size distribution.

LIST OF REFERENCE SIGNS

10: media-circulation type pulverizer
12: pulverization container
14: pulverization chamber
16: raw-material-slurry supply port
22: agitating member
24: rotary drive shaft
30: pulverizing media
31: media guide member
32: media separation member
36: discharge nozzle

50: annular partition wall
60: flow straightening blade

The invention claimed is:

1. A media-circulation type pulverizer comprising:

a pulverization container including an end plate closing up an upper end thereof and having a pulverization chamber having an upright cylindrical form and containing pulverizing media in the form of beads;

a raw-material-slurry supply section provided in the pulverization container;

an agitating member disposed in a lower region of the pulverization chamber and having a rotary shaft coaxial with a central axis of the pulverization chamber;

an annular partition wall disposed to extend upwardly from a position surrounding an outer periphery of the agitating member or a position radially away from the outer periphery by a given distance, so as to radially divide an internal space of the pulverization chamber to form an inner region of a pulverization chamber and an annular outer region of the pulverization chamber;

a media guide member provided on a central area of a lower surface of the end plate to extend downwardly and configured to turn a mixture of a raw material slurry and pulverizing media being moved upwardly through the outer region of the pulverization chamber by an action of the agitating member, to a downward flow so as to direct the mixture toward the inner pulverization chamber region;

a media separation member provided underneath the media guide member; and a product slurry discharge section provided inside the media guide member and communicating with an inside of the media separation member so as to enable a product slurry after separation of the pulverizing media by the media separation member to be discharged to outside therethrough, wherein the media-circulation type pulverizer is operable to circulate the pulverizing media between the inner region of the pulverization chamber and the outer region of pulverization chamber to pulverize a raw material in the raw material slurry by this circulating pulverizing media, and wherein the annular partition wall has a height set to be ⅗ to ⅘ of a height of the pulverization chamber, and the media guide member is formed as a downwardly tapered, circular truncated cone-shaped guide member which has a lower end which enters a space of the inner region of the pulverization chamber located inside the annular partition wall, and wherein a vertically-extending flow straightening blade is provided between said lower portion of the media guide member and an upper portion of the annular partition wall, and the media separation member is provided on the lower end of the lower portion of the media guide member.

2. The media-circulation type pulverizer as recited in claim 1, wherein the agitating member comprises a hub having a portion extended to a vicinity of a lower surface of the media guide member so as to define a small gap between an upper surface of the extended portion of the hub and the lower surface of the lower portion of the media guide member, and wherein the media separation member is a gap separator formed by the small gap.

3. The media-circulation type pulverizer as recited in claim 1, wherein the media separation member is a screen separator provided underneath the lower end of the lower portion of the media guide member.

4. The media-circulation type pulverizer as recited in claim 1, which is configured to enable cooling water to pass through an inside of the media guide member and/or an inside of the annular partition wall.

5. The media-circulation type pulverizer as recited in claim 1, wherein the pulverizing media has a diameter of 0.2 to 2.0 mm.

6. The media-circulation type pulverizer as recited in claim 1, wherein the annular partition wall is made of a resin material.

7. The media-circulation type pulverizer as recited in claim 1, wherein the annular partition wall is made of a ceramic material.

* * * * *